US006040130A

United States Patent [19]

Alton et al.

[11] Patent Number: 6,040,130

[45] Date of Patent: Mar. 21, 2000

[54] PHOTOTHERMOGRAPHIC AND THERMOGRAPHIC FILMS CONTAINING LOW LEVELS OF UNSATURATED FATTY ACID TO PREVENT FOG

[75] Inventors: Alfred J. Alton, Hilton; James P. Beese, Spencerport; Juris L. Ekmanis, Victor; Bruce J. Henne, Rochester; William F. Smith, Brockport, all of N.Y.

[73] Assignee: Eastman Kodak Company, Rochester, N.Y.

[21] Appl. No.: 08/798,202

[22] Filed: Feb. 10, 1997

[51] Int. Cl.[7] ..... G03C 1/498

[52] U.S. Cl. ..... 430/617; 430/619

[58] Field of Search ..... 430/617, 619, 430/965

[56] References Cited

U.S. PATENT DOCUMENTS

| | | |
|---|---|---|
| 2,681,294 | 6/1954 | Beguin . |
| 2,761,791 | 9/1956 | Russell . |
| 2,875,048 | 2/1959 | Haist et al. . |
| 2,941,898 | 6/1960 | Wynn . |
| 3,152,904 | 10/1964 | Sorensen . |
| 3,240,603 | 3/1966 | Grabbofer et al. . |
| 3,348,945 | 10/1967 | Mader et al. . |
| 3,411,912 | 11/1968 | Dykstra et al. . |
| 3,457,075 | 7/1969 | Morgan et al. . |
| 3,458,457 | 7/1969 | Jacques . |
| 3,525,782 | 8/1970 | Jacques . |
| 3,635,719 | 1/1972 | Ohkubo et al. . |
| 3,645,739 | 2/1972 | Ohkubo et al. . |
| 3,672,904 | 6/1972 | de Mauriac . |
| 3,700,457 | 10/1972 | Youngquist . |
| 3,706,565 | 12/1972 | Ericson . |
| 3,713,833 | 1/1973 | Lindholm et al. . |
| 3,756,829 | 9/1973 | Ohkubo et al. . |
| 3,761,279 | 9/1973 | de Mauriac et al. . |
| 3,801,321 | 4/1974 | Evans et al. . |
| 3,827,889 | 8/1974 | Ohkubo et al. . |
| 3,839,041 | 10/1974 | Hiller . |
| 3,846,136 | 11/1974 | Sullivan . |
| 3,871,887 | 3/1975 | Jones . |
| 3,960,908 | 6/1976 | Ikenoue et al. . |
| 3,997,597 | 12/1976 | Bridger et al. . |
| 4,273,723 | 6/1981 | Hayashi et al. . |
| 4,273,727 | 6/1981 | Hayashi et al. ..... 260/414 |
| 5,443,742 | 8/1995 | Mader et al. . |
| 5,512,185 | 4/1996 | Mader et al. . |

FOREIGN PATENT DOCUMENTS

| | | |
|---|---|---|
| 943476 | 12/1963 | United Kingdom . |
| 951644 | 3/1964 | United Kingdom . |
| 954453 | 4/1964 | United Kingdom . |
| 1362970K | 10/1971 | United Kingdom . |

*Primary Examiner*—Thorl Chea
*Attorney, Agent, or Firm*—Arthur H. Rosenstein

[57] ABSTRACT

A method of obtaining a photothermographic or thermographic film with reduced fog, such as pepper fog, comprises preparing a dispersion of: an oxidation-reduction image-forming combination comprising: a silver behenate oxidizing agent the improvement wherein said oxidizing agent contains less than about 800 micrograms of polyunsaturated and 3800 micrograms of monounsaturated fatty acid silver salts per gram of oxidizing agent or the film contains less than about 100 micrograms of polyunsaturated and 400 micrograms of monounsaturated fatty acid silver salts per gram of melt in the film and an organic reducing agent with a synthetic polymer-peptized photosensitive silver halide, and a cyclic imide toner in a non-gelatin polymeric binder.

15 Claims, No Drawings

PHOTOTHERMOGRAPHIC AND THERMOGRAPHIC FILMS CONTAINING LOW LEVELS OF UNSATURATED FATTY ACID TO PREVENT FOG

FIELD OF THE INVENTION

The present invention relates to a heat developable photosensitive material and more particularly to a photothermographic or thermographic composition comprising a silver salt oxidizing agent derived from a fatty acid, such as behenic acid, and an organic reducing agent, a synthetic polymer-peptized photosensitive silver halide for photothermographic and thermographic compositions and a toner in a polymeric binder.

BACKGROUND OF THE INVENTION

Silver halide photography has been much more universally employed in the past, compared with electrophotography, diazo photography and the like, because of the superior photographic characteristics such as sensitivity, gradation, etc., of silver halide photography. However, silver halide photography requires much time and labor, because the silver halide light-sensitive material employed in this method must be subjected to several processings including an image-exposure, a developing process using a developer and process for preventing the developed image from changing color or deteriorating under normal room-illumination and preventing the non-developed portion (hereinafter background) from blackening, e.g., processing including stop, fixation, washing and rinsing, stabilizing and other similar processes. In addition, the chemical agents which may be used in this method are dangerous to the human body and the processing room and the workers' hands and clothes are often stained with these agents. Therefore, it has been strongly desired to improve silver halide photography so that the light-sensitive materials can be treated in a dry condition instead of treatment with solutions, and so that the processed images are maintained stable. In order to solve this problem, many efforts have been made.

A first method which has been developed thus far includes the so-called combined developing and fixing bath method wherein two procedures in a conventional silver halide photography, developing and fixing procedures, can be replaced by one procedure, as disclosed in U.S. Pat. No. 2,875,048; British Patent No. 954,453; and German Patent Application OLS No. 1,163,142. A second method attempts to replace wet procedures in conventional silver halide photography with dry procedures, as disclosed in German Patent Application OLS No. 1,174,159; British Patent Nos. 943,476 and 951,644; and so on. A third method uses as a main light-sensitive component a silver salt of a long chain aliphatic carboxylic acid such as silver behenate, silver saccharin or silver benzotriazole, etc. and a catalytic amount of a silver halide simultaneously, as disclosed in U.S. Pat. Nos. 3,152,904; 3,457,075; 3,635,719; 3,645,739; and 3,756,829 and Canadian Patent No. 811,677; and so on.

However, the unexposed parts of the heat-developed light-sensitive materials which have so far been proposed, for example, the unexposed parts of the compositions containing the silver salts of fatty acids such as silver behenate, etc., reducing agents and catalytic amounts of silver halides become to a considerable extent black. It makes the distinction between the images and the background difficult because there is very little contrast between the black images formed on the exposed parts by heating (image density) and the fogged black background. Therefore, a reduction of fog has been an important subject in this art. Moreover, storage of light-sensitive materials for a long time before use under conditions of high temperature (30° C.–50° C.) and high humidity (more than 50% relative humidity) causes fog resulting in the formation of indistinguishable images.

A particular problem with dry laser films containing a silver behenate melt is fog, such as pepper fog, which may appear as black spots in unexposed areas on film such as microfilm.

U.S. Pat. No. 3,871,887 describes a photothermographic composition containing a halide salt to increase the photosensitivity of the photothermographic composition.

U.S. Pat. No. 4,273,723 by Hayashi et al. describes high purity silver salts of organic carboxylic acids. Column 5, lines 54 to 59 clarifies purity to the silver content of the silver behenate. This would mean that purity refers to conversion of the free acid to the silver salt. There is no measurement of the purity of the organic carboxylic acid.

In U.S. Pat. Nos. 5,443,742 and 5,512,185 the removal of reducing impurities from behenic acid and other organics by treating with AgO, and other oxidizing agents ($MnO_2$, PbO) is discussed. Analytical measurement of reducing impurities is implied to check levels of reducing impurities. No method is mentioned nor are any levels of reducing impurities given. The indications are that this standard test does not determine or is insensitive to the actual impurities present. These patents are based on a method to remove unspecified materials with no definition of what or how much is being removed.

In U.S. Pat. No. 3,997,597 the process of making Ag salts in the presence of Hg and Pb salts is described. It is proposed to affect particle size, which is tied to thermal fog, density and contrast. No tie to reducing impurities or purity of the carboxylic acid is mentioned in U.S. Pat. No. 3,960,908. Fog is related to residual alkali content.

Silver behenate and other fatty acids are used in many dry photothermographic and thermographic processes. The starting material, fatty acids from natural sources, is purchased in large lots and purified before use because the crude material has been found to cause fogging. The purification process however is quite expensive.

Many materials in a photothermographic and thermographic composition are accompanied by serious fog production. Under these circumstances, further improvement is required with respect to said photothermographic and thermographic materials.

SUMMARY OF THE INVENTION

The present invention is therefore intended to overcome problems as described above.

One object of the present invention is to provide a dry laser photothermographic or thermographic film with reduced fog, black spots or pepper fog.

Another object of the present invention is to provide a photographic material capable of forming an image of high density with less fog.

In order to achieve said objects, it has now been found according to the present invention that the foregoing problem can be related to the presence of unsaturated fatty acids in the film or specifically in the silver salt oxidizing agent which are used in the formulation of the photothermographic compound. It has been found that if the photothermographic or thermographic film contains below 100 micrograms of polyunsaturated and 400 micrograms of monounsaturated fatty acids silver salts per gram of melt in the film or if the unsaturated fatty acid silver salt concentration in the silver salt oxidizing agent is less than 800 micrograms of polyunsaturated and 3800 micrograms of monounsaturated fatty acid silver salts per gram of oxidizing agent, the fog, black spots or pepper fog are greatly reduced or eliminated. This is accomplished by assuring that the fatty acid used to formulate the oxidizing agent contains less than 1000 micrograms of polyunsaturated and 5000 micrograms of monounsaturated fatty acids per gram of saturated fatty acid.

Thus, the method of preparing a photothermographic composition comprises:

A. preparing a dispersion of:
  a. an oxidation-reduction image-forming combination comprising:
    i. a silver salt oxidizing agent prepared from a fatty acid, such as behenic acid, and
    ii. an organic reducing agent with:
  b. a synthetic polymer-peptized photosensitive silver halide, and
  c. a toner in
  d. a non-gelatin polymeric binder and B. the improvement wherein said silver salt oxidizing agent contains less than about 800 micrograms of polyunsaturated and 3800 micrograms of monounsaturated fatty acid silver salts per gram of oxidizing agent.

The method of preparing a thermographic element comprises:

A. preparing a dispersion of:
  a. an oxidation-reduction image-forming combination comprising:
    i. a silver salt oxidizing agent prepared from a fatty acid, such as behenic acid, and
    ii. an organic reducing agent with:
  b. a toner; and
  c. a non-gelatin polymeric binder; and B. the improvement wherein said oxidizing agent contains less than about 800 micrograms of polyunsaturated and 3800 micrograms of monounsaturated fatty acid silver salts per gram of oxidizing agent.

Additionally, a thermographic film can be prepared by:

A. preparing a dispersion of:
  a. an oxidation-reduction image-forming combination comprising:
    i. a silver salt of a fatty acid, such as behenic acid, oxidizing agent with
    ii. an organic reducing agent
  b. a toner in a polymeric binder
  c. a non-gelatin polymeric binder and B. mixing with said dispersion a sensitizing concentration of iodide salt and C. forming a film therefrom and D. the improvement wherein said film contains less than about 100 micrograms of polyunsaturated and 400 micrograms of monounsaturated fatty acid silver salts per gram of melt in the film.

A photothermographic film can also be prepared by:

A. preparing a dispersion of:
  a. an oxidation-reduction image-forming combination comprising:
    i. a silver salt oxidizing agent and
    ii. an organic reducing agent with:
  b. a synthetic polymer-peptized photosensitive silver halide, and
  c. a toner in
  d. a non-gelatin polymeric binder and B. mixing with said dispersion a sensitizing concentration of iodide salt and C. forming a film therefrom and D. the improvement wherein said film contains less than about 100 micrograms of polyunsaturated and 400 micrograms of monounsaturated fatty acid silver salts per gram of melt in the film.

For a better understanding of the present invention, together with other and further objects, advantages and capabilities thereof, reference is made to the following detailed description and appended claims in connection with the description of some aspects of the invention.

DETAILED DESCRIPTION OF THE PREFERRED EMBODIMENTS

The method of preparing the described photothermographic composition and element comprising a dispersion of oxidation-reduction image-forming materials with ex situ, synthetic polymer peptized photosensitive silver halide, and a cyclic imide toner in a polymeric binder can vary depending on the particular photothermographic materials, desired image, processing conditions and the like. A typical method of preparing the dispersion involves thoroughly mixing the described components. These can be mixed employing any suitable apparatus such as a ball-mill or similar mixing means. One method of preparing the described dispersion and means for preparing the dispersion are set out, for instance, in Belgian Patent No. 774,436 issued Nov. 12, 1971.

The photothermographic and thermographic elements and compositions according to the invention comprise an oxidation-reduction image-forming material which contains a silver salt oxidizing agent. The silver salt oxidizing agent can be a silver salt of an organic acid, such as a fatty acid, which is resistant to darkening upon illumination. An especially useful class of silver salts of organic acids is represented by the water-insoluble silver salts of long-chain fatty acids which are stable to light. Compounds which are suitable silver salt oxidizing agents include, for instance, silver behenate, silver stearate, silver oleate, silver laurate, silver hydroxy stearate, silver caprate, silver myristate and silver palmitate with silver stearate and silver behenate being especially useful. In some instances silver salts which are not silver salts of long-chain fatty acids can be employed as the silver salt oxidizing agent. Such silver salt oxidizing agents which are useful include, for example, silver benzoate, silver benzotriazole, silver terephthalate, silver phthalate and the like. In most instances, however, silver behenate is most useful.

A variety of organic reducing agents can be employed in the described oxidation-reduction image-forming combination. Sulfonamidophenol reducing agents are especially useful in the described oxidation-reduction image-forming combination. Sulfonamidophenol reducing agents in photothermographic materials are described in U.S. Pat. No. 3,801,321 issued Apr. 2, 1974 to Evans et al. The sulfonamidophenol reducing agents useful according to the invention can be prepared employing known procedures in the art and include such compounds as described in Canadian Patent no. 815,526 of Bard issued Jun. 17, 1969. A useful class of sulfonamidophenol reducing agents according to the invention, is represented by the structure:

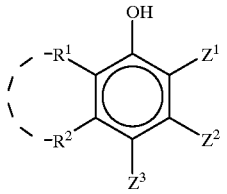

wherein $R^1$ and $R^2$ are each selected from the group consisting of hydrogen; chlorine; bromine; iodine; alkyl containing 1 to 4 carbon atoms, such as methyl, ethyl, propyl and butyl; aryl containing 6 to 12 carbon atoms such as phenyl and tolyl; arylsulfonyl containing 6 to 12 carbon atoms, such as phenylsulfonyl; amino; hydroxy; alkoxy containing 1 to 4 carbon atoms, such as methoxy and ethoxy; and atoms completing with $R^1$ and $R^2$ a naphthalene nucleus;

$Z^1$ and $Z^3$ are each selected from the group consisting of hydrogen; bromine; chlorine; alkyl containing 1 to 4 carbon atoms, as described; aryl containing 6 to 10 carbon atoms, such as phenyl and tolyl; arylsulfonyl containing 6 to 12 carbon atoms, as described; amino, hydroxy; alkoxy containing 1 to 4 carbon atoms, such as methoxy and ethoxy; and $R^6SO_2NH$— wherein $R^6$ is alkyl containing 1 to 4 carbon atoms, such as methyl, ethyl, propyl and butyl; aryl containing 6 to 10 carbon atoms, such as phenyl and tolyl and hetero ring substituents, such as thienyl, quinolinyl and thiazyl,

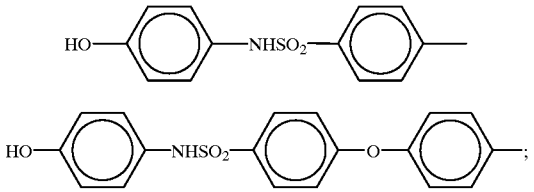

$Z^2$ is hydrogen, alkyl containing 1 to 4 carbon atoms, such as methyl, ethyl, propyl or butyl, chlorine and bromine when $R^1$ and $R^2$ are other than atoms completing a naphthalene nucleus; at least one of $Z^1$, $Z^2$ and $Z^3$ is $R^6SO_2NH$—.

The described groups such as alkyl, alkoxy and aryl include such groups containing substituents which do not adversely affect the reducing properties and desired sensitometric properties of the described photothermographic and thermographic elements and compositions. Examples of substituent groups which can be present are alkyl containing 1 to 3 carbon atoms such as methyl, ethyl, and propyl, chlorine, bromine and phenyl. In some cases it is desirable to avoid an amino group as a substituent. The amino group, in some cases, provides an overly active reducing agent.

One especially useful class of sulfonamidophenol reducing agents are compounds of the formula:

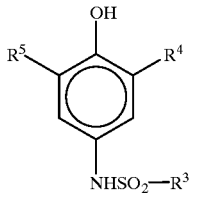

wherein $R^3$ is phenyl, naphthyl, methylphenyl, thienyl, quinolinyl, thiazyl, or alkyl containing 1 to 4 carbon atoms, as described;

$R^4$ is hydrogen, $R^3SO_2NH$—, alkoxy containing 1 to 4 carbon atoms, hydroxy, alkyl containing 1 to 4 carbon atoms, bromine or chlorine;

$R^5$ is hydrogen, bromine, chlorine, alkyl containing 1 to 4 carbon atoms, such as methyl, ethyl, propyl or butyl, or alkoxy containing 1 to 4 carbon atoms, such as methoxy, ethoxy and propoxy. $R^3$, $R^4$ and/or $R^5$ can contain substituent groups which do not adversely affect the reducing properties of the described sulfonamidophenol reducing agents or the desired sensitometric properties of the photothermographic and thermographic elements and materials of the invention. These substituent groups are the same as described for the above generic structure.

Another class of sulfonamidophenol reducing agents which are useful in photothermographic and thermographic elements and compositions of the invention are sulfonamidonaphthols of the formula:

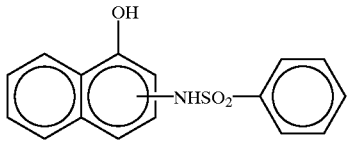

The sulfonamidophenol group in the described sulfonamidonaphthols can be in the ortho, meta or para position. The sulfonamidonaphthols are more active compounds within the sulfonamidophenol reducing agent class. Also, within this class, sulfonamidophenols which contain three sulfonamidophenol groups are more active. These sulfonamidophenols are employed for shorter developing times or with heavy metal salt oxidizing agents which are less active than silver behenate. In some cases, image discrimination provided by photothermographic and thermographic materials containing the sulfonamidonaphthols and trifunctional sulfonamidophenols is less than that provided by other of the described sulfonamidophenols.

Combinations of sulfonamidophenol reducing agents, as described, can be employed in photothermographic and thermographic materials and elements according to the invention. Especially useful sulfonamidophenol reducing agents include benzenesulfonamidophenol reducing agents, such as 2,6-dichloro-4-benzenesulfonamidophenol and/or 4-benzenesulfonamidophenol.

Other organic reducing agents which can be employed alone or in combination with the described sulfonamidophenol reducing agents include substituted phenols and naphthols, for example, bis-β-naphthols include materials such as described in U.S. Pat. No. 3,672,904 of deMauriac, issued Jun. 27, 1972. Suitable bis-β-naphthols include, for instance, 2,2'-dihydroxy-1,1'-binaphthyl; 6,-6'-dibromo-2,2'-dihydroxy-1,1'-binaphthyl; 6,6'-dinitro-2,2'-dihydroxy-1,1'-binaphthyl and/or bis-(2-hydroxy-1-naphthyl) methane. Other reducing agents which can be employed in the described photothermographic and thermographic materials according to the invention include polyhydroxybenzenes such as hydroquinone, alkyl-substituted hydroquinones such as tertiary butyl hydroquinone, methyl hydroquinone, 2,5-dimethyl hydroquinone and 2,6-dimethyl hydroquinone; catechols and pyrogallols; aminophenol reducing agents, such as 2,4-diaminophenols and methylaminophenols; ascorbic acid developing agents such as ascorbic acid and ascorbic acid derivatives such as ascorbic acid ketals; hydroxylamine developing agents; 3-pyrazolidone developing agents such as 1-phenyl-3-pyrazolidone and the like. Combinations of these reducing agents can be employed if desired. The selection of an optimum reducing agent or reducing agent combination will depend upon particular photothermographic material, silver salt oxidizing agent, processing conditions, desired image and the like.

A so-called activator-toning agent, also known as an accelerator-toning agent or toner, can be employed in the photothermographic and thermographic materials according to the invention to obtain a desired image. The activator-toning agent can be a cyclic imide and is typically useful in a range of concentration such as a concentration of about 0.10 mole to about 1.1 mole of activator-toning agent per mole of silver salt oxidizing agent in the photothermographic material. Typical suitable activator-toning agents are described in Belgian Patent No. 766,590 issued Jun. 15, 1971. Typical activator-toning agents include, for example, phthalimide, N-hydroxyphthalimide, N-hydroxy-1,8-naphthalimide, N-potassium phthalimide, N-mercury phthalimide, succinimide and/or N-hydroxysuccinimide. Combinations of so-called activator-toning agents can be employed if desired. Other activator-toning agents which can be employed include phthalazinone, 2-acetyl-phthalazinone and the like.

A photothermographic or thermographic element, as described according to the invention, can contain various non-gelatin compounds alone or in combination as vehicles, binding agents and in various layers. Suitable materials can be hydrophobic or hydrophilic. They are transparent or translucent and include such synthetic polymeric substances as water-soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Effective polymers include water-insoluble polymers of polyesters, polycarbonates, alkyl acrylates and methacrylates, acrylic acid, sulfoalkyl acrylates, methacrylates and those which have crosslinking sites which facilitate hardening or curing as well as those having recurring sulfobetaine units as described in Canadian Patent No. 774,054. Especially useful high molecular weight materials and resins include poly(vinyl butyral), cellulose acetate butyrate, poly(methyl methacrylate), poly(vinyl pyrrolidone), ethylcellulose, polystyrene, poly(vinyl chloride), chlorinated rubber, polyisobutylene, butadiene-styrene copolymers, vinyl chloride-vinyl acetate copolymers, copolymers, of vinyl acetate, vinyl chloride and maleic acid and poly(vinyl alcohol).

Soluble iodide salt has the property of increasing the photosensitivity of the described photothermographic and thermographic materials to the desired wavelengths of light for imagewise exposure. Merely adding a silver iodide melt to the photothermographic materials does not provide the desired increase in photosensitivity. Accordingly, the term iodide compounds or salts as employed herein is intended to exclude silver iodide. The useful concentration of iodide salt is about 0.01 mole to about 0.50 moles of the described iodide salt per mole of the photosensitive silver halide in the photothermographic material. Acceptable iodide salts according to the invention are, for instance, lithium iodide, ammonium iodide, sodium iodide, potassium iodide and mixtures of these iodides. Choice of optimum non-silver iodide salt and the optimum step in preparation will depend upon the particular thermographic or photothermographic composition, desired image, processing conditions and the like. Sodium iodide is especially useful when employing a reducing agent with a silver salt oxidizing agent, such as silver behenate, and an ex situ, poly(vinyl butyral) peptized photosensitive silver bromide in a polymeric binder such as poly(vinyl butyral).

A range of concentration of the described iodide salt can be employed. The concentration must be sufficient to provide the desired increase in photosensitivity in the described photothermographic composition. Typically, a concentration of iodide salt is about 0.01 mole to about 0.50 mole of the described non-silver iodide salt per mole of photosensitive silver halide in the described photothermographic material. A concentration of non-silver iodide salt which is about 0.01 mole to about 0.05 mole of the iodide, typically sodium iodide, per mole of the described silver halide is usually preferable.

The described iodide salt can be mixed with the described photothermographic compositions at different states of preparation of the composition.

Accordingly, one embodiment of the invention comprises a method of preparing a silver halide photothermographic composition or element comprising respectively A. preparing a dispersion of a silver salt of a fatty acid such as silver behenate in poly(vinyl butyral), B. mixing with the resulting silver behenate dispersion about 0.01 to about 0.05 mole of sodium iodide per mole of silver halide in the photothermographic composition, C. mixing with the resulting composition with an ex situ, poly(vinyl butyral) peptized photosensitive silver halide, and D. a poly(vinyl butyral) binder, and E. mixing succinimide, a sulfonamidophenol reducing agent and a spectral sensitizing dye with the resulting composition.

Another embodiment of the invention comprises a method of preparing a silver halide, photothermographic composition or element comprising respectively A. preparing poly(vinyl butyral) peptized photosensitive silver halide, B. mixing with said silver halide about 0.01 to about 0.50 mole of sodium iodide per mole of said silver halide, C. mixing with the resulting composition a dispersion of silver behenate in poly(vinyl butyral), and D. then mixing succinimide, a sulfonamidophenol reducing agent and a spectral sensitizing dye with the resulting composition.

In preparing a photothermographic material according to the invention, it is often desirable to mix the described iodide salt with the photothermographic material and then hold the resulting composition for a period of time until the desired sensitivity is achieved, such as about 10 seconds to about 48 hours at room temperature, that is about 20° C. to about 30° C. before any subsequent steps. It appears that this holding step provides some interaction which is desired for the described increase in photosensitivity. The exact mechanism of reaction which takes place is not fully understood.

After the holding period, the photothermographic composition can be coated on a suitable support to provide a photothermographic element.

Accordingly, a further embodiment of the invention comprises preparing a photothermographic composition comprising (A) preparing a dispersion of (a) an oxidation-reduction image-forming combination comprising (i) a silver salt oxidizing agent (silver behenate) and (ii) a sulfonamidophenol reducing agent, with (b) ex situ, synthetic polymer peptized photosensitive silver halide, in (c) a poly (vinyl butyral) binder, and, after preparing the dispersion, (B) mixing with the dispersion about 0.01 mole to about 0.50 mole, of the described iodide salt, typically sodium iodide, per mole of the silver halide, and then (C) holding the resulting composition for a period of time until the desired sensitivity is achieved, such as about 10 seconds to about 48 hours at about 20° C. to about 30° C. before any subsequent step.

After the holding step, a photothermographic element can be prepared by coating the described composition on a suitable support.

The photothermographic and thermographic elements according to the invention can comprise a wide variety of supports. Typical supports include cellulose nitrate film, cellulose ester film, poly(vinyl acetal) film, polystyrene film, poly(ethylene terephthalate) film, polycarbonate film and related films or resinous materials, as well as glass, paper, metal and the like supports which can withstand the processing temperatures employed according to the invention. Typically, a flexible support is employed.

It is desirable, in some cases, to employ an image stabilizer and/or image stabilizer precursor in the described photothermographic or thermographic materials of the invention. Typical image stabilizers or stabilizer precursors are described, for example, in Belgian Patent No. 768,071 issued Jul. 30, 1971. Typical stabilizer precursors include, for example, azole thioethers and blocked azoline thione stabilizer precursors as described in this Belgian Patent and described in U.S. Pat. No. 3,700,457 of Youngquist, issued Oct. 24, 1972.

The described photothermographic and thermographic compositions and elements according to the invention can contain various addenda to aid the compositions and elements such as development modifiers that function as additional speed-increasing compounds, hardeners, antistatic layers, platicizers and lubricants, coating aids, brighteners, spectral sensitizing dyes, absorbing and filter dyes, also as described in the Product Licensing Index, Volume 92, December 1971, publication 9232, pages 107–110.

Spectral sensitizing dyes can be used in the described photothermographic and thermographic materials of the invention to confer additional sensitivity to the elements and compositions of the invention. Useful sensitizing dyes are described, for example, in the Product Licensing Index, Volume 92, December 1971, publication 9232, pages 107–110, paragraph XV and Belgian Patent No. 772,371 issued Oct. 15, 1971. For example, when a photothermographic material is to be exposed imagewise to a so-called red laser, a spectral sensitizing dye which provides a sensitivity to the red region of the spectrum is employed in the described photothermographic material according to the invention.

The photothermographic composition and other compositions according to the invention can be coated on a suitable support by various coating procedures including dip coating, air knife coating, curtain coating or extrusion coating using hoppers such as described in U.S. Pat. No. 2,681,294 issued Jun. 15, 1954. If desired, two or more layers can be coated simultaneously such as described in U.S. Pat. No. 2,761,791 issued Sep. 4, 1956 and British Patent No. 837,095.

A range of concentration of various components of the materials can be employed according to the invention. A useful concentration of reducing agent is typically about 0.25 mole to about 4 moles of reducing agent, such as sulfonamidophenol reducing agent, per mole of photosensitive silver halide in the photothermographic materials. In relation to the silver salt oxidizing agent employed, a useful concentration range of reducing agent is typically about 0.10 mole to about 20.0 moles of reducing agent per mole of silver salt oxidizing agent, such as silver behenate. If a combination of reducing agents is employed, the total concentration of reducing agent is typically within the described concentration range.

It is believed that upon imagewise exposure the latent image silver of the described photosensitive silver halide acts as a catalyst for the described oxidation image-forming combination. A typical concentration range of photosensitive silver halide is about 0.01 mole to about 20 moles of photosensitive silver halide per mole of silver salt oxidizing agent, for instance, silver behenate. Preferred photosensitive silver halides are silver chloride, silver bromide, silver bromoiodide, silver chlorobromoiodide or mixtures thereof. The photosensitive silver halide can be coarse or fine-grain, very fine-grain photosensitive silver halide being especially useful. The photosensitive silver halide can be chemically sensitized, can be protected against the production of fog and/or stabilized against the loss of sensitivity during keeping, as described in the Product Licensing Index reference mentioned previously.

The described ex situ, synthetic polymer peptized photosensitive silver halide can be prepared with a range of synthetic polymer peptizers. Useful synthetic polymer peptizers include, for example, those described in U.S. Pat. No. 3,713,833 of Lindholm et al., issued Jan. 30, 1973 and U.S. Pat. No. 3,706,565 of Ericson, issued Dec. 19, 1972, and vinyl pyridine polymers, e.g., polymers of 2-vinyl pyridine, 4-vinylpyridine and 2-methyl-5-vinylpyridine.

Poly(vinyl acetals), such as poly(vinyl butyral), are especially useful as peptizers in the described preparation of ex situ silver halide. The procedure can be carried out in a non-aqueous medium under controlled reaction conditions. For instance, an organic solvent, such as acetone or methylisobutyl ketone, can be employed with the peptizer, such as poly(vinyl butyral). An example of a suitable preparation of photosensitive silver halide is as follows: Lithium bromide, silver trifluoroacetate and poly(vinyl butyral) are mixed in acetone under controlled conditions. The resulting, fine-grain silver bromide can then be mixed with an oxidation-reduction image-forming combination, such as a sulfonamidophenol with silver behenate, to provide a photothermographic material.

The silver halide employed in the practice of the invention can be unwashed or washed to remove soluble salts. In the latter case, the soluble salts can be removed by chill-setting and decantation or a melt containing the silver halide can be coagulation-washed.

Poly(vinyl acetal) peptized photosensitive silver halide is useful and is described, for example, in Belgian Patent No. 774,436 issued Nov. 12, 1971. The photosensitive silver halide is prepared according to this method by mixing a source of silver ions with a source of halide ions in the presence of a poly(vinyl acetal) such as poly(vinyl butyral). This polymer peptized photosensitive silver halide is especially useful when the photothermographic material contains a polymeric binder which is the same as the polymer employed to peptize the silver halide. For example, the polymeric binder can be poly(vinyl butyral) which can be employed to peptize the photosensitive silver halide.

An especially useful embodiment of the invention is in a photothermographic composition comprising the combination of (a) an oxidation-reduction image-forming combination comprising (i) silver behenate with (ii) a sulfonamidophenol reducing agent, as described, with (b) poly(vinyl butyral) peptized silver halide in (c) a poly(vinyl butyral) binder, the improvement comprising (d) about 0.01 mole to about 0.50 mole, such as about 0.01 mole to about 0.15 mole, of sodium iodide per mole of the silver halide. With this composition an especially useful activator-toning agent is succinimide.

After imagewise exposure of the described photothermographic element according to the invention, typically to visible light, the resulting latent image can be developed merely by uniformly overall heating the element to moderately elevated temperatures. This merely involves overall heating the described photothermographic element to about 80° C. to about 250° C. such as for about 0.5 seconds to about 60 seconds. In thermographic elements, the desired heating is at about 60° C. to about 225° C. for about 0.001 to 60 seconds. By increasing or decreasing the length of time of heating, a higher or lower temperature within the desired range can be employed depending upon the desired image, particular photothermographic and thermographic materials and the like. A developed image is typically produced within several seconds, such as about 0.5 second to about 60 seconds. A processing temperature of about 100° C. to about 165° C. is especially useful.

While visible light can be employed to produce the latent image, other sources of electromagnetic radiation can be employed. For example, the described photothermographic and thermographic elements of the invention are useful for high intensity imagewise exposure. A laser can be employed to produce an image in the described photothermographic and thermographic material.

Any suitable means can be used for providing the desired processing temperature range. The heating means can be a simple hot plate, iron, roller or the like.

Processing is usually carried out under ambient conditions of pressure and humidity. Conditions outside normal atmospheric pressure and humidity can be employed if desired.

If desired, one or more components of the photothermographic and thermographic elements described can be in one or more layers of the element. For example, in certain cases it can be desirable to include certain percentages of the reducing agent, activator toner, image stabilizer and/or stabilizer precursor in a protective layer over the photothermographic and thermographic elements. This in some cases can reduce migration of certain addenda in the layers of the photothermographic and thermographic elements.

The development process for photothermographic and thermographic products is thermal. Thus, its chemistry is different from the traditional black and white paper and negative products. Silver behenate is used along with the usual silver halide. The silver behenate is made from behenic acid. Rape seed oil, which is high in erucic acid, $C_{22}H_{42}O_2$, is fractionated and reduced to form saturated fatty acids, including behenic acid and other saturated fatty acids. This mixture is then fractionally distilled to separate the lower molecular weight portion. One cut from the higher temperature distillate is collected for use containing a mixture of the higher molecular weight fatty acids, predominantly behenic acid. This crude fatty acid is further purified before use, which adds to the expense of the process.

It is noted that in the above preparations the fatty acid used must contain less than 1000 micrograms of polyunsaturated and 5000 micrograms of monounsaturated fatty acid. Thus, the fatty acid must be tested first for unsaturated fatty acid content and then the concentration of unsaturated fatty acids, if high, can be reduced by conventional procedures for removing same. The unsaturated fatty acid content in the fatty acid and in the photothermographic and thermographic elements can be determined by gas chromatography/mass spectrometry (GC/MS) as described below.

The GC/MS of fatty acids is problematic because of poor peak shape and the absence of a molecular ion. Methyl esters of fatty acids exhibit a strong molecular ion and the chromatographic peak shape is excellent. The samples of fatty acid were weighed into vials and dissolved in toluene. The methyl esters were formed by addition of $BF_3$ in methanol and heating to 60° C. for one hour. This solution was injected, in the split mode, into the GC/MS for analysis.

The GC/MS employed for the analysis was a Hewlett-Packard 5890 Gas Chromatography with a Hewlett-Packard 5970 MSD. A 30 meter long by 0.25 millimeter inside diameter with a 0.25 micrometer film DB5 MS column was used and the GC conditions were 40 (1 minute) to 320 at 10° C. a minute. The head pressure was 5 pounds/in$^2$ and the split flow was 30 cc/min. A 2.0 microliter injection was made for each sample.

GC/MS was used to characterize different lots of fatty acid of known good and poor photographic performance. The GC/MS analysis detected components at a level less than 0.1% by area. Several components were found at elevated levels in the poor performing fatty acids versus the better performing samples. These components were identified as unsaturated materials related to behenic acid on the basis of the observed molecular weight and fragmentation pattern. Several components containing one unsaturation and one each containing two and three unsaturations were detected in the poorest performing fatty acid sample. The best performing fatty acid sample contained no detectable components with two or three unsaturations and very low levels of components containing one unsaturation.

In the case of photothermographic or thermographic films wherein the unsaturated fatty acid is from other sources in the film, the film must not contain more than 100 micrograms of polyunsaturated and 400 micrograms of monounsaturated fatty acid silver salts per gram of melt in the film.

If the composition of the fatty acids contain greater than 1000 micrograms of polyunsaturated or 5000 micrograms of monounsaturated fatty acids per gram of starting fatty acids, then the fatty acids are further purified.

The following example is included for a further understanding of the invention.

EXAMPLE 1

Five lots of fatty acid with varying photographic performance, from very good to very poor, were chosen to assess the performance differences. Crude lot 510 and purified lot 510 were the poorest in photographic performance and purified Lot 843 was the best performer. The Crude lot 843 and Crude lot 686 were found to exhibit intermediate performance. Behenic acid, $C_{22}H_{44}O_2$, is a straight chain fatty acid. These acids generally do not behave well by Gas Chromatography (GC) (their peak shape is poor) and they do not exhibit a molecular ion in Electron Impact Mass Spectrometry. Fatty acid derivatization to the methyl ester greatly improves the chromatographic performance and also improves the usefulness of information gained by Mass Spectrometry by enhancing the molecular ion formation.

The five samples were methylated with $BF_3$ in methanol and analyzed by GC/MS. The major responses in all of the samples were the same, with methyl behenate being the largest component, by far. The mass spectrum of the methyl ester of behenic acid exhibits a molecular ion and fragmentation pattern indicating the ester and the hydrocarbon backbone. The other large responses were all determined to be related to behenic acid, the differences being in the chain length of the carbon chain, as determined by the observed molecular ion. Hydrocarbons obtained from a natural source are typically mixtures with variations in units of $C_2H_4$ in the hydrocarbon chain lengths, as observed here for the major components.

The difference between the samples was reflected in the varying concentrations of minor components. Compounds identified as unsaturated analogs of behenic acid and other homologs by the observed molecular weight and fragmentation pattern were detected at levels of one area percent and below. The sensitometric performance data correlates with the presence or absence of the unsaturated analogs. The identity of the highest level of these unsaturated species was determined to be $H_{33}C_{17}COOCH_3$ by the difference of two in nominal mass from the closely eluting saturated analog, indicating a loss of two hydrogens, and the fragmentation pattern in the hydrocarbon portion of the mass spectrum. Related polyunsaturated materials eluting very close to this component were identified as $H_{31}C_{17}COOCH_3$ and $H_{29}C_{17}COOCH_3$ having observed molecular weight decreases of four and six daltons, respectively, from the saturated analog. The worst performing samples, Lot 510 and purified Lot 510, were found to contain the highest levels of monounsaturated and polyunsaturated compounds.

Several analytical standards were purchased and used to determine the levels of the unsaturated materials. A standard of the $C_{18}H_{32}O_2$, di-unsaturated fatty acid, was methylated as well as a sample of the Crude lot 510 and analyzed by GC/MS. The data indicated the area percent data was very close to the weight percent data. The methyl ester of the monounsaturated C18 acid was determined at 1% in the Crude 510 sample, which is at least five times higher than in the good to fair performing samples.

The best performing fatty acid sample, Purified Lot 843 contained no detectable components with two or three unsaturations and very low levels of components containing one unsaturation. The correlation of varying levels of unsaturated compounds and fog levels in the product have shown that the unsaturated materials are a cause of fog in silver behenate systems.

The GC/MS analysis of derivatized behenic acid has shown the presence of unsaturated analogs. The presence and the level of these unsaturated materials correlate to the sensitometric performance of coatings made from the fatty acid. Higher levels of unsaturates leads to a higher fog level in the sensitometric testing.

While the invention has been described with particular reference to a preferred embodiment, it will be understood by those skilled in the art that various changes can be made and equivalents may be substituted for elements of the preferred embodiment without departing from the scope of the invention. In addition, many modifications may be made to adapt a particular situation or material to a teaching of the invention without departing from the essential teachings of the present invention.

We claim:

1. A method of preparing a photothermographic composition comprising:

A. preparing a dispersion of:

a. an oxidation-reduction image-forming combination comprising:

i. a silver salt of a fatty acid oxidizing agent and ii. an organic reducing agent with:

b. a synthetic polymer-peptized photosensitive silver halide, and c. a toner in d. a non-gelatin polymeric binder and B. the improvement wherein said composition contains less than about 800 micrograms of polyunsaturated and 3800 micrograms of monounsaturated fatty acid silver salts per gram of oxidizing agent.

2. The method of claim 1 wherein the oxidizing agent is mixed with a sensitizing concentration of iodide salt.

3. The method of claim 1 wherein the oxidizing agent contains no unsaturated fatty acid.

4. The method of claim 1 wherein the toner is a cyclic imide.

5. A method of preparing a thermographic composition comprising:

TABLE 1

Summary of GC/MS Analysis of Fatty Acid Samples

| | | Area Percent | | | | |
|---|---|---|---|---|---|---|
| Unsaturation | Formula | Crude 510 | Purified 510 | Crude 843 | Purified 843 | Crude 686 |
| 0 | $H_{23}C_{11}COOCH_3$ | 0.1 | 0.1 | 0.1 | ND | 0.11 |
| 0 | $H_{31}C_{15}COOCH_3$ | 0.3 | 0.1 | 0.05 | ND | 0.36 |
| 3* | $H_{29}C_{17}COOCH_3$ | 0.5 | 0.25 | ND | ND | ND |
| 2* | $H_{31}C_{17}COOCH_3$ | | | | | |
| 1 | $H_{33}C_{17}COOCH_3$ | 1 | 0.8 | 0.08 | ND | 0.19 |
| 0 | $H_{35}C_{17}COOCH_3$ | 1.4 | 0.8 | 2.26 | 1.4 | 2.8 |
| 0 | $H_{39}C_{19}COOCH_3$ | 7.8 | 6.3 | 7.76 | 6.1 | 2.8 |
| 0 | $H_{41}C_{20}COOCH_3$ | 0.36 | 0.36 | 0.2 | trace | 0.11 |
| 1 | $H_{41}C_{21}COOCH_3$ | 0.5 | 0.1 | 0.6 | 0.16 | 0.44 |
| 0 | $H_{43}C_{21}COOCH_3$ | 81.7 | 85.5 | 84.8 | 89.8 | 85.1 |
| 0 | $H_{45}C_{22}COOCH_3$ | 0.4 | 0.4 | 0.37 | 0.1 | 0.44 |
| 1 | $H_{45}C_{23}COOCH_3$ | 0.4 | trace | ND | ND | ND |
| 0 | $H_{47}C_{23}COOCH_3$ | 5.2 | 5.3 | 3.46 | 2.2 | 6.2 |

*2 and 3 are reported together.

A. preparing a dispersion of:

a. an oxidation-reduction image-forming combination comprising:

i. a fatty acid silver oxidizing agent and ii. an organic reducing agent with:

b. a toner;

c. a non-gelatin polymeric binder and

B. the improvement wherein said oxidizing agent contains less than about 800 micrograms of polyunsaturated and 3800 micrograms of monounsaturated fatty acid silver salts per gram of oxidizing agent.

6. The method of claim 5 wherein the dispersion comprises an iodide salt.

7. The method of claim 6 wherein the iodide salt concentration is about 0.01 mole to about 0.50 moles per mole of photosensitive silver halide.

8. The method of claim 5 wherein the toner is a cyclic imide.

9. A photothermographic composition comprising the combination of:

a. an oxidation-reduction image-forming combination comprising:

i. a silver behenate salt oxidizing agent containing less than 800 micrograms of polyunsaturated and 3800 micrograms of monounsaturated fatty acid silver salts per gram of oxidizing agent;

ii. an organic reducing agent, b. a synthetic polymer peptized photosensitive silver halide; and c. a toner in a polymeric binder.

10. The composition of claim 9 wherein the composition comprises an iodide salt.

11. A thermographic composition comprising the combination of:

a. an oxidation-reduction image-forming combination comprising:

i. a silver behenate oxidizing agent wherein the composition comprises less than about 800 micrograms of polyunsaturated and 3800 micrograms of monounsaturated fatty acid silver salts per gram of oxidizing agent;

ii. an organic reducing agent; and b. a toner in a polymeric binder.

12. The composition of claim 11 comprising an iodide salt.

13. A photothermographic film comprising the combination of:

a. an oxidation-reduction image-forming combination comprising:

i. a silver behenate oxidizing agent, the improvement wherein said film contains less than about 100 micrograms of polyunsaturated and 400 micrograms of monounsaturated fatty acid silver salts per gram of melt in the film ii. an organic reducing agent, b. a synthetic polymer peptized photosensitive silver halide and c. a toner in a polymeric binder.

14. The film of claim 13 comprising an iodide salt.

15. A thermographic film comprising the combination of:

a. an oxidation-reduction image-forming combination comprising:

i. a silver behenate oxidizing agent, the improvement wherein the film contains less than about 100 micrograms of polyunsaturated and 400 micrograms of monounsaturated fatty acid silver salts per gram of melt in the film;

ii. an organic reducing agent; and b. a toner in a polymeric binder.

* * * * *

UNITED STATES PATENT AND TRADEMARK OFFICE

CERTIFICATE OF CORRECTION

PATENT NO. : 6,040,130
DATED : March 21, 2000
INVENTOR(S) : Alton et al.

It is certified that error appears in the above-identified patent and that said Letters Patent is hereby corrected as shown below:

Title page,
Item [75], Inventor "James P. Beese" should read -- James P. Besse --.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*